United States Patent [19]

Traglia

[11] Patent Number: 4,903,366

[45] Date of Patent: Feb. 27, 1990

[54] SELF WRINGING MOP

[76] Inventor: Peter Traglia, 3306 Crescent St., Long Island City, N.Y. 11106

[21] Appl. No.: 237,276

[22] Filed: Aug. 26, 1988

[51] Int. Cl.[4] ..... A47L 13/144

[52] U.S. Cl. ..... 15/119 R; 15/119 A

[58] Field of Search ..... 15/119 R, 260, 119 A

[56] References Cited

U.S. PATENT DOCUMENTS

| | | | |
|---|---|---|---|
| 419,387 | 1/1890 | Westbrook | 15/119 R |
| 605,961 | 6/1898 | Kurz | 15/119 R |
| 776,981 | 12/1904 | Amsden | 15/119 R |
| 1,271,301 | 7/1918 | Feasel | 15/119 R |
| 1,858,879 | 5/1932 | Carlson | 15/119 R |
| 1,999,450 | 4/1935 | Fatland | 15/119 R |
| 2,145,536 | 1/1939 | Watson | 15/119 R |
| 2,274,880 | 3/1942 | Bodimer | 15/119 R |

*Primary Examiner*—Chris K. Moore

*Attorney, Agent, or Firm*—Richard L. Miller

[57] ABSTRACT

This self wringing mop is designed to make mopping floors faster and easier. Primarily, it consists of an upper frame with a handle, and a wringer block and roller are secured in the frame for effecting a rotating wringing effect. A plurality of foam plastic mop strips are employed as mopping elements and are supported from a strip support frame in the mop assembly, and the foam plastic mop strips are especially designed for long life in the mop.

6 Claims, 3 Drawing Sheets

SELF WRINGING MOP

BACKGROUND OF THE INVENTION

The instant invention relates generally to mops, and more particularly, to a self-wringing mop.

Numerous mops have been provided in the prior art that are adapted to be employed on floors and the like. While these units may be suitable for the particular purpose to which they address, they would not be as suitable for the purpose of the present invention as hereafter described.

SUMMARY OF THE INVENTION

A primary object of the present invention is to provide a self-wringing mop that will overcome the shortcomings of the prior art devices.

Another object is to provide a self-wringing mop that will be of such design, as to employ at least two lengths of foam plastic mop strips in a frame for mopping purposes, and a roller containing device will be provided in the structure for the wringing thereof.

An additional object is to provide a self-wringing mop that will include a rotatable handle for the wringing of the foam plastic mop strips.

A further object is to provide a self-wringing mop that is simple and easy to use.

A still further object is to provide a self-wringing mop that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
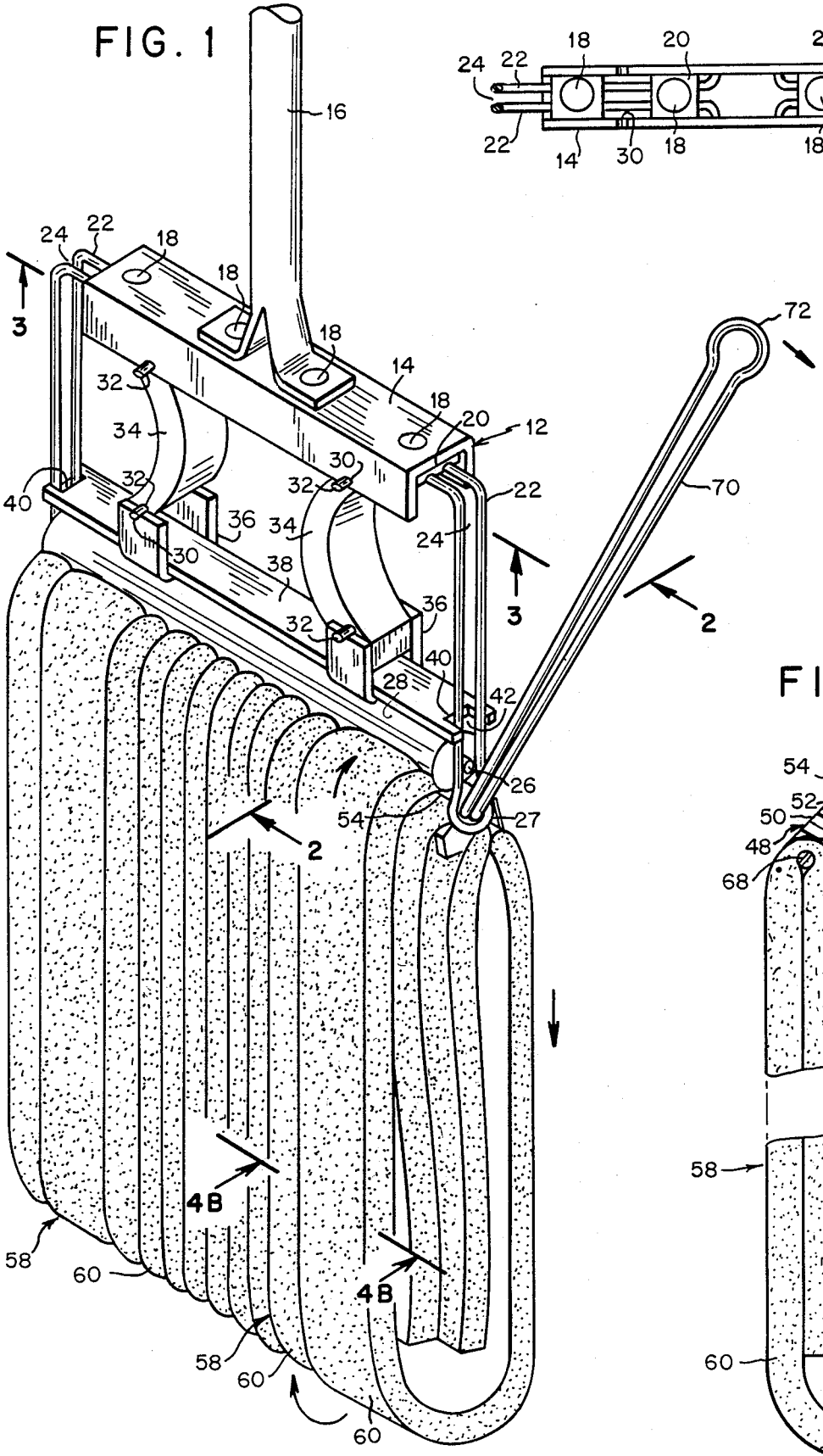
FIG. 1 is a perspective view of the instant invention shown in a wringing position.
Figure 3:
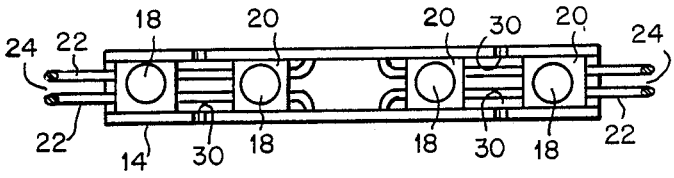
FIG. 3 is a diagrammatic cross sectional view taken on line 3—3 of FIG. 1.
Figure 2:
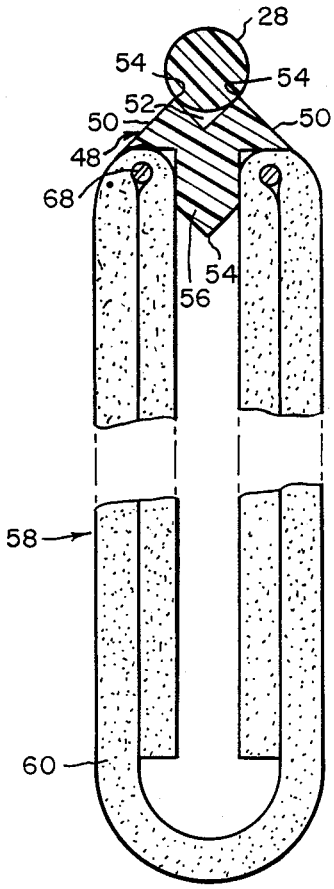
FIG. 2 is an enlarged diagrammatic cross sectional view taken on line 2—2 of FIG. 1.

Turning now descriptively to the drawings, in which like reference characters denote like elements throughout the several views, a mop 100 is shown to include a main frame 12 composed of an upper channel 14 having a handle 16 fixedly secured to its top surface by a pair of two out of four fasteners 18. Hold-down plates 20 are provided and grooved to retain rods 22, and the other fasteners 18 are received in the openings 23 of channel 14 and plates 20 for fixedly securing rods 22, plates 20, and handle 16. A space 24 is provided between extending leg portions of rods 22 and freely receives end stub shafts 26 that are fixedly secured in wringer roller 28, and a loop 27 is formed on the ends of rods 22, for a purpose which will hereinafter be described.

A pair of cut-out openings 30 are provided in the edges of side portions of channel 14, and removably receive projecting pins 32 in one end portion of a pair of rubber compression strips 34 in frame 12. Similar pins 32 are provided in the opposite ends of strips 34, and are removably received in other cut-out openings 30 provided in ends of a pair of spaced channel brackets 36. A compression plate 38 is provided and includes a cut-out opening 40 in each end, and rods 22 are freely received in the openings 40 and serve as guides for the plate 38.

A pair of projections 42 are integrally attached to plate 38, for riding in the spaces 24 between rods 22. The pair of channel brackets 36 are fixedly secured to plate 38 by fasteners 44 received in openings 46, and the channel brackets 36 normally engage with the outer peripheral surface of roller 28, by pressure created by the compression strips 34 that are arcuately formed when in the assembly of the mop 10.

A wringer block 48 is provided and includes angularly sloped sides 50 and a longitudinal top opening 52 normally seats the outer peripheral surface of roller 28, until mop wringing is effected. The pair of longitudinal edges 54 defined by the opening 52 and the sides 50, serve as a seat for roller 28. The projecting bottom portion 56 of block 48 serves to separate end portions of a plurality of elongated foam plastic mop strips 58.

It shall be noted that the roller 28 and the wringer block 48 are preferably fabricated of plastic material.

Figure 4A:
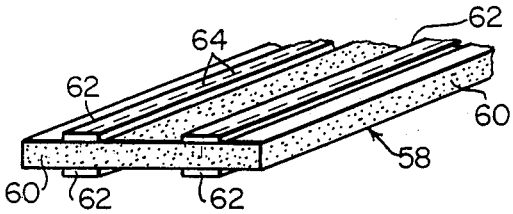
FIG. 4A is a fragmentary perspective view of one the mop elements strips, shown in dry condition.
Figure 4B:
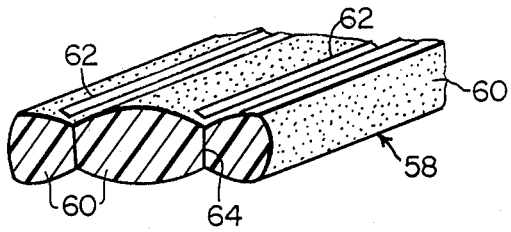
FIG. 4B is a fragmentary perspective view with a cross sectional cut taken along line 4B—4B of FIG. 1, one the mop elements strips, shown in wet condition.
Figure 5:
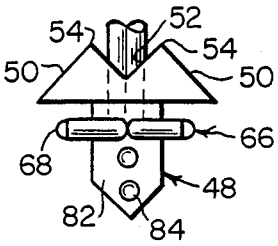
FIG. 5 is an end elevational view of the base portion of the sponge holder and locking mechanism of the instant invention, shown removed therefrom.
Figure 6:
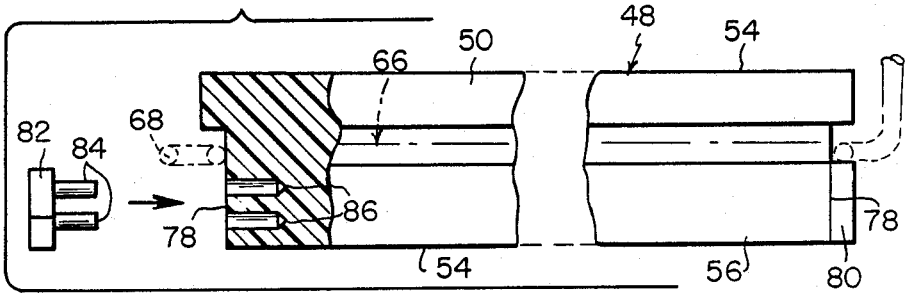
FIG. 6 is a side elevational view of the mechanism, shown partly broken away and one cap exploded therefrom.
Figure 7:
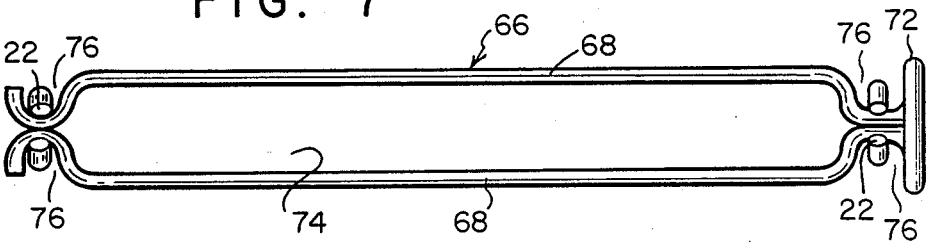
FIG. 7 is a top plan view of the mop elements strips support and rotatable wringer handle combined, shown removed from the invention.
Figure 8:
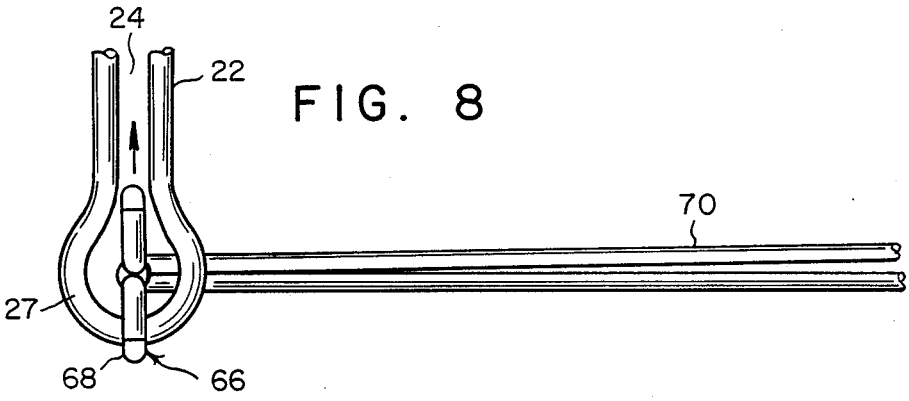
FIG. 8 is a fragmentary end elevational view of the invention, with the mop elements strips removed, showing the mop elements strips supports and handle combination in position for removal from the assembly.

Looking now at FIG. 4A and 4B particularly, each mop strip 58 is composed of a plurality of separate equal lengths of foam strips 60. A reinforcing cloth tape 62 is stitched on each side by stitches 64, so as to fixedly secure the strips 60 together.

Figure 10:
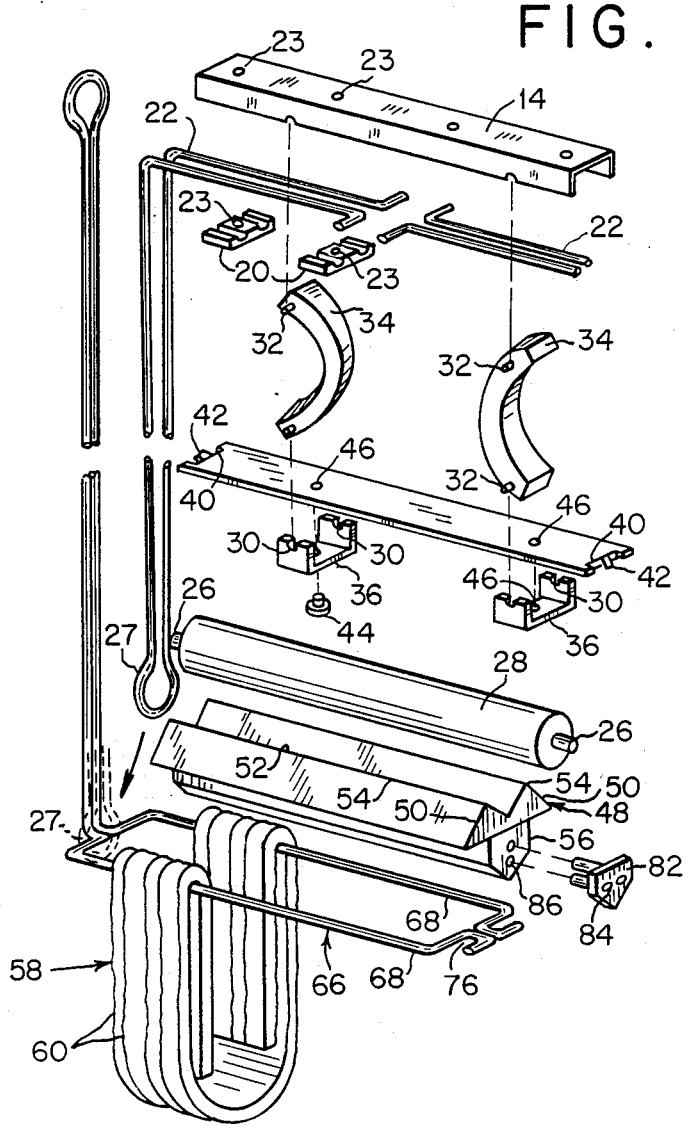
FIG. 10 is a partial exploded perspective view further illustrating details of construction of the instant invention.

As best understood from viewing FIG. 10, a strip support frame 66 is provided and is composed of a pair of strip support rods 68 having a wringer handle 70 formed at right angles and including an outer loop 72. A space 74 between rods 68 provides for receiving and retaining end portions of strips 58 that are employed for mopping, and one end of support rods 68 is curved inward to form openings 76 that receives a rod 22. The opposite end of strip support frame 66 also includes openings 76 that receives the other rod 22.

Recesses 78 are formed in the bottom end portions of the wringer block 48, and an end cap 80 is fixedly secured to one end of wringer block 48, in a manner (not shown). A second end cap 82 is provided and includes a pair of spaced pins 84 fixedly secured therein that are frictionally force fitted into openings 86 provided in one end of wringer block 48. This block 84 is removable for the purpose of removing strip support frame 66 to change worn strips 58.

The ends of the strip support frame are supported on top of the end caps 80 and 82, and end portions of the strips 58 depend downward on the inside of strip support frame 66. The projecting bottom portion 56 of wringer block 48, serves as a separator and spacer.

Figure 9:
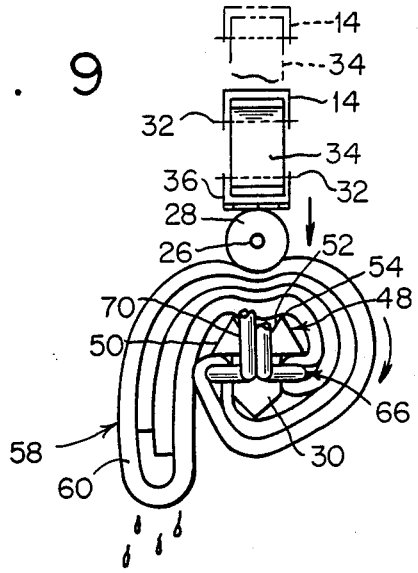
FIG. 9 is a diagrammatic side view illustrating the wring action of the mop.

In use, mop 100 is employed in the conventional manner to mop floors. When it is desired to wring out the water from the strips 58, the handle 70 is grasped and rotated as shown, causing the wringer block 48 to also rotate and wind the strips 58 thereon. As the above occurs, the strips 58 are forced between the roller 28 and compression force from the rubber compression strips 34, causes the outer periphery of the roller 28 to force against the strips 58 to press the water therefrom, (as best illustrated in FIG. 9).

After wringing, reverse rotation is effected to bring the strips 58 back to normal position, and it is to be recognized that the handle 70 is then left in the normally full upright position.

When removing a worn plurality of strips 58 from mop 10, the second end cap 82 is forced off of the wringer block 48 and the strip support frame 66 is removed from the wringer block 48, after which, new strips 58 are placed thereon, and strip support frame 66 is replaced and the second end cap is again put into place by forcing the pins 84 into the openings 86 of the wringer block 48.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self-wringing mop comprising, a main frame, a wringer roller received in said main frame, providing a first engagement means against a plurality of mop strips removably received on a mop strip support frame, and a wringer block received in said main frame, for retaining said mop strip support frame and providing a second engagement means against said mop strips for wringing water from said mop strips, by squeezing said mop strip between said roller and said wringer block, wherein said main frame includes a channel having a pair of rods secured within by suitable fasteners, and said pair of rods extend downward on each side of said channel and each are doubled to form a space that freely receives an end shaft fixedly secured in said wringer roller having an outer peripheral surface normally in engagement with a pair of channel brackets fixedly secured to a compression plate, wherein an opening is provided in each end of said compression plate and receives said pair of rods and said rods serve as guide means for said compression plate when said compression plate and said wringer roller are moved upward during wringing of said mop wherein a loop is formed in an end of said rods and removably receives ends of said mop strip support frame, and spring pressure means for normally engaging said channel brackets with said wringer roller, wherein said spring pressure means comprises a pair of spaced apart and removable rubber compression strips having pins projecting from each end, and said pins of said compression strips are removably received in cut-out openings provided in edges of said channel and said channel brackets, and said compression strips are normally arcuate in configuration when mounted in said main frame, and a wringer handle is formed in one end of said mop strip support frame and is received in one said loop of said rods where by said handle may be rotated by an operator to wring said mop.

2. A self-wringing mop as set forth in claim 1, wherein said mop strip support frame includes a pair of spaced apart mop strip support rods, one end being formed into said wringer handle that is at right angles to said support rods, and said mop strip support rods removably receive end portions of said mop strips and said end portions depend downward in a space defined between said mop strip support rods, and said mop strip support frame is removably received on said wringer block.

3. A self-wringing mop as set forth in claim 2, wherein said wringer block includes angularly sloped sides and a longitudinal top opening that normally seats said wringer roller until wringing of said mop is effected, and a pair of longitudinal edges are defined by the longitudinal opening and engage with said mop strips when said mop strips are passed between said wringer roller and said wringer block, and a projection on an opposite side of said wringer block is provided with a similar said edge that also engages with said mop strips when said mop strips are passed between said wringer roller and said wringer block, and said projection is integrally attached to said wringer block and extends between said strip support rods and said end portions of said mop strips.

4. A self-wringing mop as set forth in claim 3, wherein said wringer block is recessed on each end and a first end cap is fixedly secured on a recessed portion of one end of said wringer block and a top of said first end cap supports one end of said mop strip support frame, and a second end cap supports another end of said mop strip support frame and is removable from another end of said mop strip support frame enabling said mop strip support frame to be removed to replace said mop strips, and said second end cap includes a pair of spaced pins that are fixedly secured in said second end cap and said pins are frictionally force fittable into openings provided in a second recessed portion of said another end of said wringer block, and said mop strip support frame normally engages with one side edge of said first end cap and one side edge of said second end cap.

5. A self-wringing mop as set forth in claim 4, wherein said mop strip support frame is rotatively received in said rods secured to said channel, and when said handle is rotated, said mop support frame, said wringer block, and said wringer roller are rotated, causing said mop strips to be squeezed between said points of said wringer block and said wringer roller.

6. A self-wringing mop as set forth in claim 5, wherein each mop strip of said plurality of mop strips comprises a length of foam plastic reinforced by stitching at least a single length of reinforcing tape material to said mop strip.

* * * * *